US006720935B2

(12) United States Patent
Lamensdorf et al.

(10) Patent No.: US 6,720,935 B2
(45) Date of Patent: Apr. 13, 2004

(54) SINGLE AND DUAL-BAND PATCH/HELIX ANTENNA ARRAYS

(75) Inventors: David Lamensdorf, Concord, MA (US); Michael Smolinski, Lowell, MA (US)

(73) Assignee: The Mitre Corporation, Bedford, MA (US)

( * ) Notice: Subject to any disclaimer, the term of this patent is extended or adjusted under 35 U.S.C. 154(b) by 0 days.

(21) Appl. No.: 10/194,027

(22) Filed: Jul. 12, 2002

(65) Prior Publication Data

US 2004/0008153 A1 Jan. 15, 2004

(51) Int. Cl.[7] ..... H01Q 1/36

(52) U.S. Cl. ..... 343/895; 343/700 MS; 343/702; 343/853

(58) Field of Search ..... 343/700 MS, 702, 343/725, 830, 846, 895, 850, 853

(56) References Cited

U.S. PATENT DOCUMENTS

| | | | | |
|---|---|---|---|---|
| 4,963,879 A | * | 10/1990 | Lin | 343/792 |
| 5,255,005 A | | 10/1993 | Terret et al. | 343/895 |
| 5,793,338 A | | 8/1998 | Standke et al. | 343/895 |
| 5,828,348 A | | 10/1998 | Tassoudji et al. | 343/895 |
| 5,838,282 A | | 11/1998 | Lalezari et al. | 343/727 |
| 5,896,113 A | | 4/1999 | O'Neill, Jr. | 343/895 |
| 5,920,292 A | | 7/1999 | O'Neill, Jr. | 343/895 |
| 5,963,180 A | | 10/1999 | Leisten | 343/895 |
| 5,986,616 A | | 11/1999 | Edvardsson | 343/853 |
| 6,005,521 A | * | 12/1999 | Suguro et al. | 343/700 MS |
| 6,011,516 A | | 1/2000 | Minegishi et al. | 343/702 |
| 6,028,558 A | | 2/2000 | Van Voorhies | 343/742 |
| 6,150,981 A | * | 11/2000 | Suguro et al. | 343/700 MS |
| 6,150,994 A | | 11/2000 | Winter et al. | 343/895 |
| 6,163,300 A | | 12/2000 | Ishikawa et al. | 343/702 |
| 6,184,845 B1 | | 2/2001 | Leisten et al. | 343/895 |
| 6,218,998 B1 | | 4/2001 | Van Voorhies | 343/741 |
| 6,229,489 B1 | | 5/2001 | Holshouser et al. | 343/702 |
| 6,239,760 B1 | | 5/2001 | Van Voorhies | 343/742 |
| 6,281,859 B1 | | 8/2001 | Winter et al. | 343/895 |
| 6,483,471 B1 | * | 11/2002 | Petros | 343/725 |

* cited by examiner

*Primary Examiner*—Shih-chao Chen
(74) *Attorney, Agent, or Firm*—Choate, Hall & Stewart

(57) ABSTRACT

Single and dual frequency band spatial null steering antenna arrays are disclosed, comprised of primary resonant quadrifilar helix antennas and auxiliary resonant patch antennas, which comprise stacked patches in the dual-band embodiments. Several feed networks are described for producing, preferably, circularly polarized radiation in satellite frequency bands (e.g., L1 and L2) with pattern nulls steerable to desired elevation angles. Various top and bottom-fed quadrifilar helix antennas configurations are also described.

51 Claims, 13 Drawing Sheets f=1.575 GHZ f=1.563 GHZ f=1.215 GHZ f=1.587 GHZ f=1.227 GHZ f=1.239 GHZ

SINGLE AND DUAL-BAND PATCH/HELIX ANTENNA ARRAYS

The U.S. Government has certain rights in this patent as provided for by the terms of contract No. 03016132 A8, NAVWAR FY01 awarded by the Department of Defense.

FIELD OF THE INVENTION

The invention relates generally to antennas for use in communication and navigation systems. In particular, the invention relates to a single or dual band antenna array for receiving and/or transmitting circularly polarized signals in the presence of hostile or unintentional interference.

BACKGROUND OF THE INVENTION

Many contemporary communications and navigation products have been developed that rely on earth-orbiting satellites to provide necessary communications and navigation signals. Examples of such products include satellite navigation systems, satellite tracking and locator systems (e.g., GPS), and communications systems (e.g., NAVSTAR) that rely on satellites to relay the communications signals from one station to another. In order for these products to be operationally useful as hand-held equipment, the antennas they employ should be small (comparable or smaller in size than the receiver itself).

Several types of antennas are now used with hand-held GPS receivers. All are relatively compact and can receive circularly polarized signals from any direction above the ground (e.g., hemispherical coverage, although gain along the ground or horizon can be reduced). The requirement for compact size has several performance benefits in addition to its obvious portability. It enables the radiation pattern of an antenna to have slowly varying gain and low frequency dispersion over most of the field of view. The latter is important to provide the desired location accuracy. But any communications or navigation system is susceptible to degradation due to interfering conditions. Carrier signals are vulnerable to interruption by natural phenomena, interference from other signals or countermeasures. Countermeasures may take the form of a variety of jamming schemes whose sole purpose is to disrupt the operation of a receiver.

Multipath is a significant problem in both navigational and communications systems. It degrades navigational accuracy in GPS systems and can be a source of interference in communications systems. Multipath can be caused by "structural" reflections from specular reflecting surfaces of numerous scattering sources common to an urban environment such as buildings, large vehicles, aircraft or ships. Alternatively, multipath can be caused by ground reflections at low grazing angles off the moist ground, rooftops, sea surface or a large body of water close to the antenna. Since GPS satellites transmit right-handed circularly polarized (RHCP) signals, and the polarization of a multipath signal after reflection is normally reversed, the rejection of the cross-polarized (left-handed circularly polarized, LHCP) signals is important in avoiding multipath problems.

Various types of antennas have been proposed for decreasing the effects of interference. In addition to their large size, most have large numbers of radiating elements that make them unsuitable for use in hand-held devices such as GPS receivers. Additionally, most do not allow operation in more than one frequency band. For the next generation of GPS hand-held receivers being developed for the military, it will be necessary to receive circularly polarized signals in two frequency bands, (L1 and L2). In addition, it is desired to be able to suppress active interference signals (e.g., jammers) by predictively or adaptively placing a radiation pattern minimum in the direction of that interference. This requires one or more auxiliary antennas whose output would be combined with the output of the primary antenna(s) with an adaptive weight to appropriately shape the pattern.

Thus, a need exists for a simple predictive or adaptive antenna array compact enough to be suitable for use in a hand-held device, yet which is capable of receiving and/or transmitting circularly polarized signals in more than one (preferably satellite) frequency band while providing a relatively high gain quasi-hemispherical radiation pattern over those bands.

SUMMARY OF THE INVENTION

The present invention provides an antenna array that is operationally useful in hand-held communications and navigation (e.g., GPS) transceivers and receivers. Some embodiments of the antenna array are capable of receiving and/or transmitting circularly polarized signals within separate frequency bands. In addition, in order to suppress incident signals that would potentially interfere with the desire signal, a pattern minimum (predictive or adaptive) can be steered in the direction of an interfering signal. An appropriate amplitude and phase weight is applied to the output of an auxiliary antenna such that, when combined with the output of a primary antenna, generates the pattern minimum. The pattern minimum created by this two-element antenna array will have a conical shape with the axis of the cone along a line separating the primary and auxiliary antenna elements. Because most interfering signals are anticipated to arrive from a direction close to the horizon, a vertical displacement between the primary and auxiliary elements is preferred, though not required, in order to steer the pattern minimum along the horizon while providing maximum pattern gain in the upper hemisphere.

Antennas that are electrically small, passive and have low ohmic loss will have a relatively narrow bandwidth and high Q. Essentially such antennas are resonant circuits, with the non-ohmic loss representing radiation. By modifying the design of such antennas to be the equivalent of a double-tuned resonant circuit, they may operated efficiently in two distinct frequency bands (e.g., L1 and L2). This is a technique used in certain embodiments of the present invention, wherein the technique is applied to both a quadrifilar helix antenna (QHA) and a microstrip patch antenna (patch).

In a first embodiment, the present invention provides a spatial null steering antenna array comprised of a primary QHA resonating circularly polarized radiation in a desired frequency band and means for feeding the QHA in phase quadrature (i.e., feed signals having relative phase differences of 0°, 90°, 180° and 270° from an input signal) such as described below. Coaxially aligned and vertically displaced from the QHA is an auxiliary patch antenna resonant in the same frequency band. The patch is stacked atop a dielectric substrate layer and a ground plate. The positions of the patch, substrate layer and patch ground plate are fixed relative to the QHA. A means for applying an appropriate amplitude and phase weight to feed signals feeding the patch results in a combined circularly polarized radiation pattern minimum at selected elevation angles. The desired frequency band is preferably a satellite frequency band, such as either of the L1 or L2 bands.

Several QHA designs are known to artisans. In one bottom-fed embodiment, the QHA is comprised of four radiating elements arranged helically with a left-hand twist to define a cylinder of constant radius, each radiating element having an electrically open end below the patch ground plate and another end having an electrically conductive feed location, and a QHA ground plane coaxially positioned below the four radiating elements. In some embodiments, the radiating elements have sufficient rigidity to be self-support, while in others they are structurally supported. In other top-fed embodiments, the need for a QHA ground plane is eliminated by taking advantage of the inherent backfire nature of QHA's. In these top-fed embodiments, the radiating elements have a right-hand twist and the electrically-open and feed-location ends are inverted. The radiating elements may be comprised of strips of electrically conductive material printed on a dielectric support. The radiating elements each has a length preferably less than or equal to the wavelength in free space of the signals being fed, and each preferably completes one helical turn about the (imaginary) defined cylinder.

In certain preferred embodiments, the auxiliary patch feed signals are transported from the patch feed means to the patch via a conduit located coaxially within and extending above the QHA. The conduit also preferably transports the QHA feed signals in certain top-fed embodiments. In some embodiments, the conduit also serves as portion of a support mechanism for fixing the position of the patch, substrate layer and patch ground plate relative to the QHA. The patch may be fed predictively, as mentioned above, with appropriately amplitude and phase weighted feed signals to achieve a pattern minimum at the horizon. Alternatively, the patch may be fed by an adaptive weighting feed network in order to steer the pattern minimum to other elevations from where interfering signals may be arriving.

In another embodiment, the present invention provides a dual-band spatial null steering antenna array comprised of a primary dual-band QHA and a coaxially aligned and vertically displaced auxiliary stacked patch antenna, each of which is resonant in a first frequency band and a second frequency band, means for feeding the dual-band QHA to produce circularly polarized radiation in the first frequency band and the second frequency band, and means for feeding the stacked patch antenna to produced circularly polarized radiation such that, when combined with the output of the dual-band QHA, generates pattern minima in the first and second frequency bands at selected elevation angles. The first and second frequency bands are preferably, but not limited to, the L2 and L1 GPS bands, respectively.

An auxiliary stacked patch antenna as used herein comprises a patch ground plane coaxially aligned with and vertically displaced above the dual-band quadrifilar helix antenna, and a first auxiliary patch resonant in the first frequency band and a second auxiliary patch resonant in the second frequency band coaxially aligned and vertically stacked on a dielectric substrate layer on top of the patch ground plate. The first auxiliary patch and second auxiliary patch may be feed predictively or adaptively by the patch feed network in each of the two frequency bands. Appropriate feeding may occur simultaneously in both frequency bands, or alternating between the two frequency bands as desired.

As in the single frequency band embodiments of the present invention, a means for supporting the position of the auxiliary stacked patch antenna relative to the dual-band QHA is preferably employed, as well as an optional means for supporting the structure of the dual-band QHA. The auxiliary stacked patch support means may similarly comprise a conduit mechanism through which patch feed signals are transported from the patch feed network.

Several dual-band QHA's are known and may be employed, but in preferred embodiments the present invention employs trap-loaded QHA's as described below. Generally speaking, trap-loaded QHA's employ radiating elements in which are inserted parallel LC circuits whose impedance in the second frequency band is significantly higher than in the first frequency band, thus effecting the double tuning mentioned above. The details of the trap-loaded QHA and the combination of its output radiation pattern with that of the auxiliary stacked patch antenna will be described in detail below.

DETAILED DESCRIPTION OF CERTAIN PREFERRED EMBODIMENTS OF THE INVENTION

Certain embodiments of the invention will now be described with reference to the accompanying figures. The present invention is directed toward microstrip patch/quadrifilar helix antenna arrays operable in either single frequency or multiple frequency bands. It should be noted that the description of the invention in terms of a GPS receiver is exemplary only, and in no way intended to be limiting. Artisans will readily appreciate that the rule of reciprocity allows the structures described below to be equally applicable to signal transmission, such as in communications systems.

Single-Band Null-Steering Arrays

Figure 1:
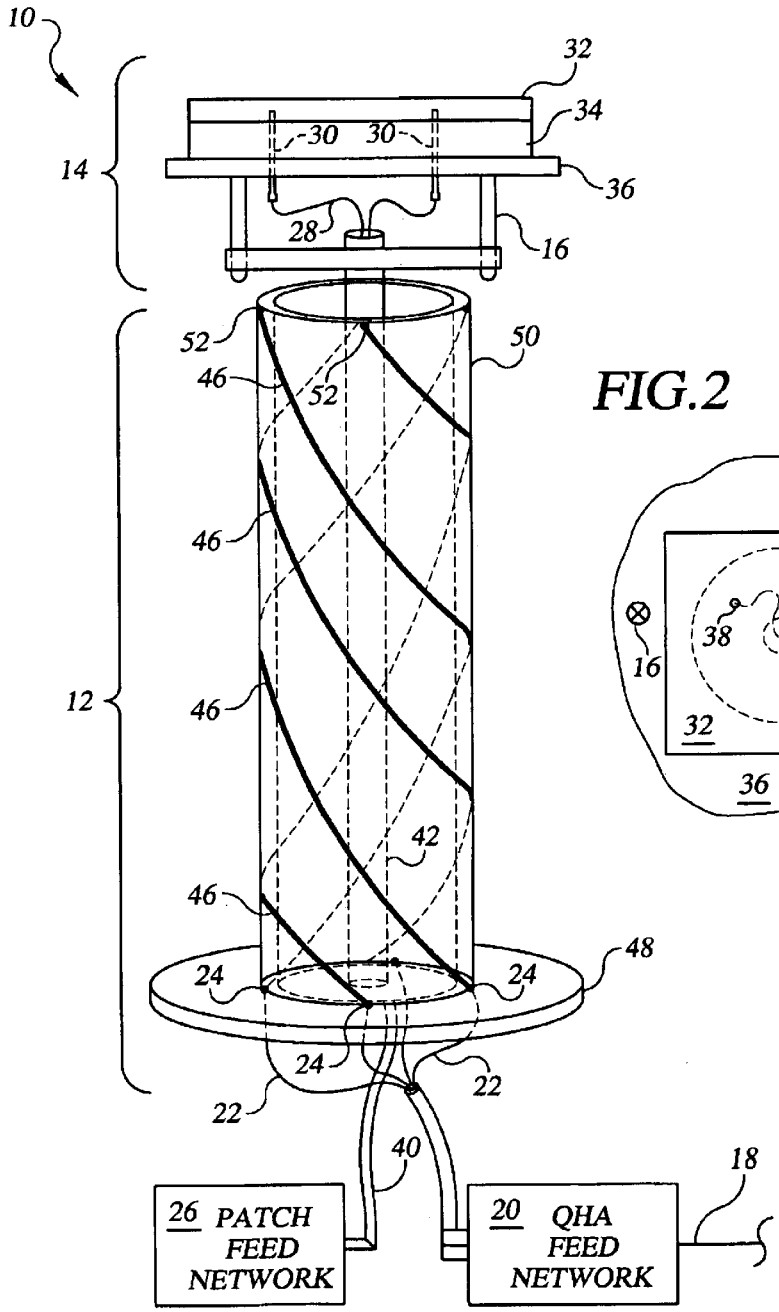
FIG. 1 is an illustration of a side view of a first embodiment of an antenna array in accordance with the invention.
Figure 2:
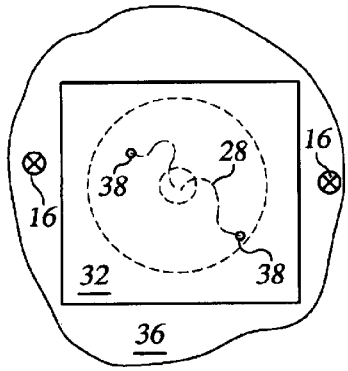
FIG. 2 is an illustration of a top view of the first embodiment.

In a first embodiment depicted in FIGS. 1 and 2, the present invention comprises an array 10, which itself is comprised of a QHA 12 and a microstrip patch antenna 14 that is coaxially aligned with and vertically displaced above the QHA 12. The QHA 12 and the patch antenna 14 are both resonant in the same frequency band, which is preferably a satellite frequency band (e.g., L1 or L2), although other bands are possible. Through appropriate predictive or adaptive excitation, the patch antenna 14 operates as an auxiliary element to the primary element QHA 12, allowing the steering of a circularly polarized radiation pattern minimum to a desired elevation from which interfering signals are being received. A means for supporting the patch 14 relative to the QHA 12 is depicted to be a rigid bracket 16 connected to the bottom of the patch 14. Any support means may be employed provided it does not interfere with the radiation patterns produced and the support means has sufficient rigidity to maintain a constant separation distance between the QHA 12 and patch 14.

In order to produce circularly polarized radiation, the QHA 12 is excited by signals in phase quadrature, i.e., four equi-amplitude signals whose phases have been shifted relative to an input signal 18 by 0°, 90°, 180° and 270°. The phase shifting and power-splitting of the input signal 18 is accomplished by a QHA feed network 20. Four signals 22 are output from the QHA feed network 20 and fed to feeding locations 24 of the QHA 12. By reciprocity, the antenna array receives circularly polarized signals from any direction in space with the same phasing network. Various configurations for feeding a patch antenna in order to produce circularly polarized radiation patterns are known.

The auxiliary patch antenna 14 is comprised of a patch element 32 stacked upon a dielectric substrate layer 34 and a ground plate 36. The microstrip patch element 32 preferably has a symmetric (e.g., square or round) shape and is dimensioned to be resonant in the desired frequency band. The bandwidths of patch antennas usually are narrower than for the QHA. Additionally, patches' polarization ratio near (or below) the horizon is not as desirable as QHA's. However, its smaller size is an obvious benefit. The assignee of the present application has developed microstrip patch antennas for GPS receivers using high dielectric materials ($\epsilon>10$) to reduce the area of the patch (See Rao, B. Rama et al., "Characterizing the Effects of Mutual Coupling on the Performance of a Miniaturized GPS Adaptive Array", GPS-ION Symposium, September 2000, Salt Lake City, the contents of which are hereby incorporated by reference in their entirety.) If the axial separation between the two antennas is almost $\lambda/2$, the pattern minimum near the horizon will be relatively narrow. Also, when a minimum for the combined pattern is created near the horizon, this separation plus the phase weight will cause the two patterns to add coherently above the horizon increasing the overall gain of the adapted antenna pattern.

A patch feed network 26 adaptively or predictively provides appropriately amplitude and phase weighted output signals 28 to patch feed pins 30 in such a manner as to generate an output radiation pattern that, when combined with the radiation output pattern of QHA 12, results in a circularly polarized pattern minimum at a desired elevation angle. In a preferred embodiment (as shown in FIGS. 1 and 2), wherein a circularly polarized pattern minimum is desired at the horizon, patch feed network 26 provides, through use of a 90° hybrid (not shown), two patch feed signals 28 with a 90° phase offset. Patch element 32 has two feed pins 30 for receiving the two patch feed signals 28. In a preferred embodiment, the feed pins 30 extend down through holes 38 in the dielectric substrate layer 34 and ground plate 36. The longitudinal axes of these holes are aligned with the axis of the QHA 12. Note that circularly polarized radiation in a narrower bandwidth could alternatively be provided by a single probe (one per patch), eliminating the need for the 90° feed hybrid. The patch feed signals 28 may be transported on coaxial feed cables 40 disposed within a metal tube 42 extending along the central axis of QHA 12 with negligible impact on the array's performance. In certain embodiments, tube 42 also serves as part of the support means for the patch antenna 14, providing structural support for bracket 16. Since each radiating element has a diametrically opposed radiating element that is driven out of phase, axially directed electric fields induced by the currents generated in the opposed radiating elements tend to cancel along the axis of QHA 12. Consequently, the coupling to conducting tube 42 is minimized. Simulations and experiments conducted by the applicants have demonstrated negligible impact of a tube with an approximate diameter of 0.36". More complex weighting and/or phase-shifting schemes, or structures employing alternative electrical connections for producing circular polarization which tracks the primary QHA 12 may be employed.

FIG. 1 illustrates a bottom-fed quadrifilar helix antenna 12 in accordance with an embodiment of the present invention. Each of four radiating elements 46 of the QHA 12 is comprised of an electrically small conductor, such as a wire or flat ribbon, helically arranged such that they each traverse one helical turn, thereby defining a cylinder. A small ground plane 48 is arranged perpendicularly to the cylinder defined by the radiating elements 46. The ground plane 48 is preferably circularly dimensioned and has a diameter greater than one third of the free space wavelength of the signals being received and/or transmitted.

The helical arrangement of the radiating elements 46 preferably has a left-hand twist in order to transmit and/or receive right hand circularly polarized signals and compensate for changes in the sense of polarization caused by reflections of circularly polarized electromagnetic signals from planar conductors. According to certain preferred embodiments, the radiating elements 46 are comprised of strips of electrically conductive material printed on a dielectric support. The microstrip substrate is rolled or formed into a symmetric, preferably cylindrical shape, so that the radiating elements are wound about a central axis. The diameter of the cylindrical shape is judiciously selected according to the desired impedance and bandwidth of the antenna. This cylindrical shape for the embodiments discussed below is not required to have a circular cross section. As long as the cross section represents an evenly distributed symmetrical shape, such as a rounded square, hexagon, octagon, and so forth, it is functional within the teachings of the present invention. Additionally, those skilled in the art will readily appreciate that some changes may be required to alter the radiation pattern of the antenna commensurate with the expected use of the antenna and operational requirements of a particular communication or navigation system. For example, a discussion of pitch alteration effects can be found in C. C. Kilgus, "Shaped Conical Radiation Pattern Performance of the Backfire Quadrifilar Helix", *IEEE Trans. AP*, May 1975, p392–7, the contents of which are hereby incorporated by reference. The overall length of each radiating element 46 is selected for resonant operation in the desired frequency band in which the array 10 is intended to operate. Resonant operation typically requires a radiating element length which is approximately an odd integer multiple of a quarter wavelength . In certain embodiments, the radiating elements 46 have sufficient rigidity such that they are self-supporting. In other embodiments, the radiating elements 46 may be supported by a cylindrical support structure 50. For example, in an experimental model described below, a Styrofoam cylinder provides structural support to the radiating elements. Foam typically has a dielectric constant of less than 1.1. Higher dielectric constant material will allow the antenna to be made smaller, but also will reduce bandwidth (and radiation resistance).

Figure 6:
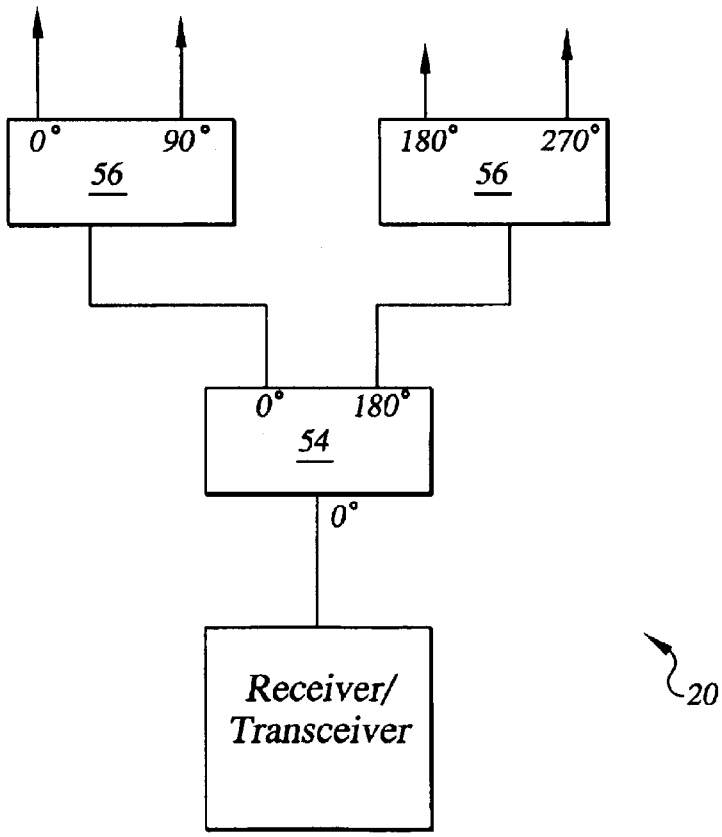
FIG. 6 is a block diagram of a quadrifilar helix feed network in accordance with the invention.

Each of the radiating elements 46 is electrically open at one end 52 and has one of the conductive feed locations 24 at the other end. QHA feed network 20 provides the 0°, 90°, 180° and 270° phase-shifted signals 22 needed to supply feed locations 24, through holes in ground plane 48, in order to produce circularly polarized radiation. Illustrated in FIG. 6 is a QHA feed network 20 comprised of a 180° hybrid 54 and two 90° hybrids 56. The output of the 180° hybrid 54 is fed into the two 90° hybrids 56. These hybrids devices have proven useful in implementing the teachings of the invention. However, those skilled in the art will appreciate that other known signal transfer structures besides those illustrated herein can be used. The QHA feed means simply requires production of four signals for the radiating elements 46 with substantially equal power and appropriate phase relationships. The choice of a specific feed network structure depends on design factors known by those skilled in the art, such as manufacturability, reliability, cost, and so forth.

A purpose of the ground plane 48 is to direct the radiation pattern of the QHA 12 in the forward axial direction. QHA's are inherently backfire antennas, therefore the ground plane 48 is a necessary reflector in certain embodiments.

Figure 3:
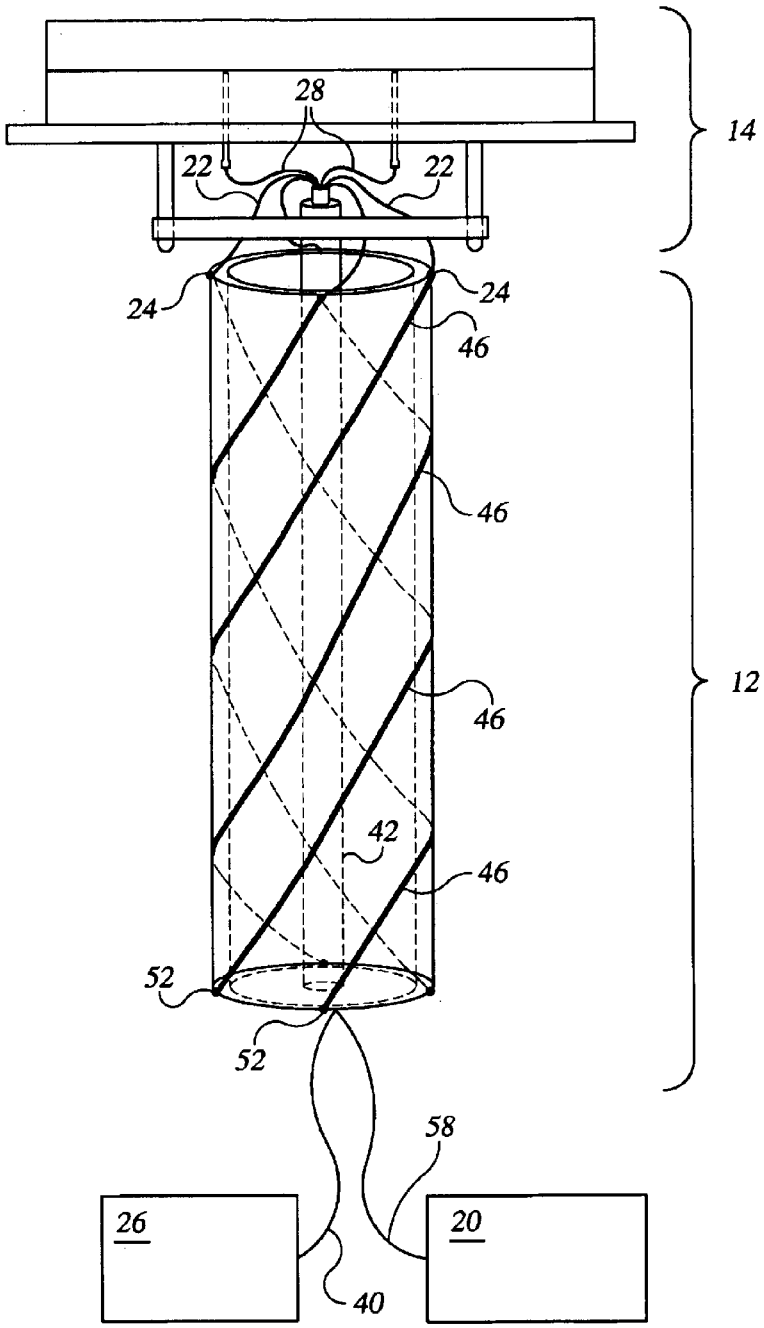
FIG. 3 is an illustration of a side view of a second embodiment of an antenna array in accordance with the invention.

In certain alternative embodiments, one of which is depicted in FIG. 3, the need for a ground plane is eliminated by feeding the radiating elements 46 at the feed locations 24, which are, in these embodiments, located at the "top" of the antenna, and by changing the rotational twist of the radiating elements to a right-hand twist. The reference to "top" here means the end of the radiating elements 46 closer to the patch 14. In these embodiments, the QHA feed signals 22 may be transported via coaxial cables 58 from the feed network 20 to the feed locations 24 through tube 42, which also transports patch feed signals 28.

Multiple-Band Null Steering Arrays

In another embodiment, the present invention provides an antenna array capable of steering circularly polarized radiation pattern minima to selected elevation angles in separate frequency bands (e.g., L1 and L2). The desired patterns are generated by a compact antenna array 59 comprised of a primary dual-band QHA 60 and coaxially aligned and vertically displaced auxiliary stacked patch antenna 61.

In a preferred embodiment illustrated in FIG. 4 the primary antenna is a trap-loaded QHA 60 such as described in the applicant's co-pending U.S. application Ser. No. 10/174,330 entitled "Dual-Band Quadrifilar Helix Antenna", filed Jun. 18, 2002, the contents of which are a incorporated by reference herein in their entirety. In both of its operating frequency bands, the trap-loaded QHA has a relatively small gain variation. It also has low axial ratio (low cross-polarization) over the hemisphere, which can suppress multipath reflections. Other dual-band helical configurations (e.g., concentric and interleaved helices)may also be used as primary antennas with some degradation of overall array performance, however use of the trap-loaded QHA 60 minimizes the number of duplexers required in the nulling circuit, with a single output port from the trap-loaded QHA (after a hybrid combining network) for both frequency bands and two output ports from the auxiliary stacked patch antenna (one for each frequency) 61.

Figure 7:
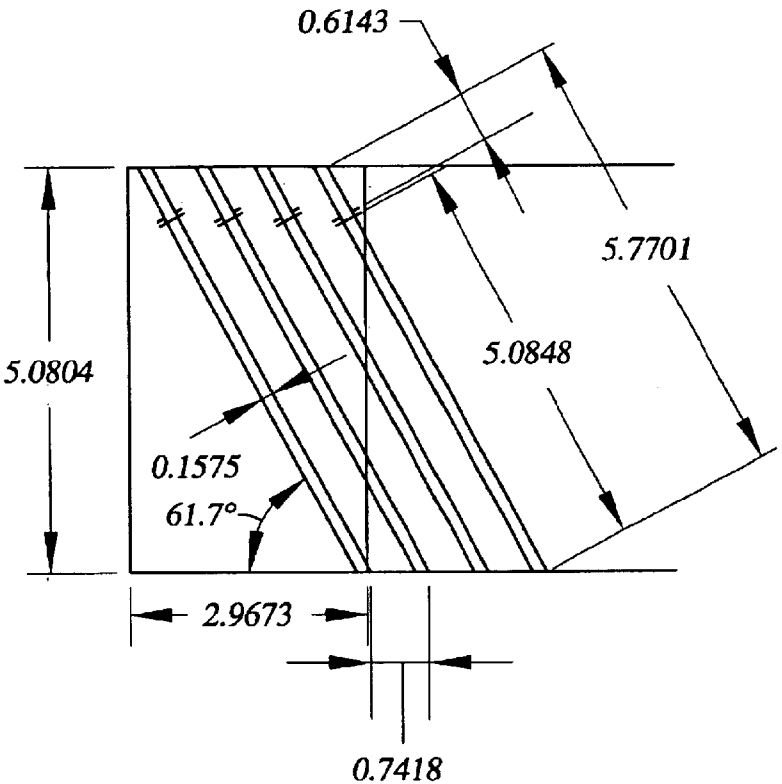
FIG. 7 is a schematic diagram of radiating elements employed in creating a quadrifilar helix antenna in accordance with the invention.

Each of the four radiating elements 62 of the trap-loaded QHA 60 is comprised of an electrically small conductor, such as a wire or flat ribbon, having an upper portion 64 and a lower portion 66 and a trap circuit 72 disposed in a gap 68 between the upper portion and the lower portion. The trap-loaded QHA shares a number of characteristics with the QHA described above. Each of its radiating elements 62 are helically arranged with a left twist for obtaining right hand circular polarization, and may be similarly rolled or formed from a microstrip substrate (as shown in FIG. 7) into a symmetric shape about a central axis. The radiating elements 62 may also similarly be self-supporting or supported by a support structure 68 conforming to the symmetric shape. The dimensioning of this preferably cylindrical shape will be affected by the pattern shaping and bandwidth design choices described above. The overall length of each radiating element 62 (including the trap 72) is selected for resonant operation in a first frequency band, the first frequency band being the lower of the two frequency bands at which the antenna array 59 is intended to operate. Resonant operation typically requires a radiating element length which is approximately an odd integer multiple of a quarter wavelength. Each of the upper portions 64 of the radiating elements 62 is electrically open at one end 70 and electrically connected to a trap circuit 72 at the other end 74. Each of the lower portions 66 is electrically connected to the trap circuit 72 at one end 76 and is electrically connected to a QHA feed network 78 through conductive feed points 80 located at the other end. An advantage of present invention is that both frequency bands may be fed through the feed points 80. To provide resonant operation in the higher frequency band, the radiating elements 62 are designed such that the trap circuits 72 are disposed between each upper portion 64 and lower portion 66 at a point such that all of the upper portions 64 are of equal lengths and all of the lower portions 66 are of equal lengths. That is, the trap circuits 72 are equidistant from the respective open ends 70 of the radiating elements 62 in which they are disposed. This position is selected to be the point at which the resulting length of the lower portions 64 of the radiating elements 62 corresponds to resonance at the second (higher) frequency.

Figures 4A, 4B:
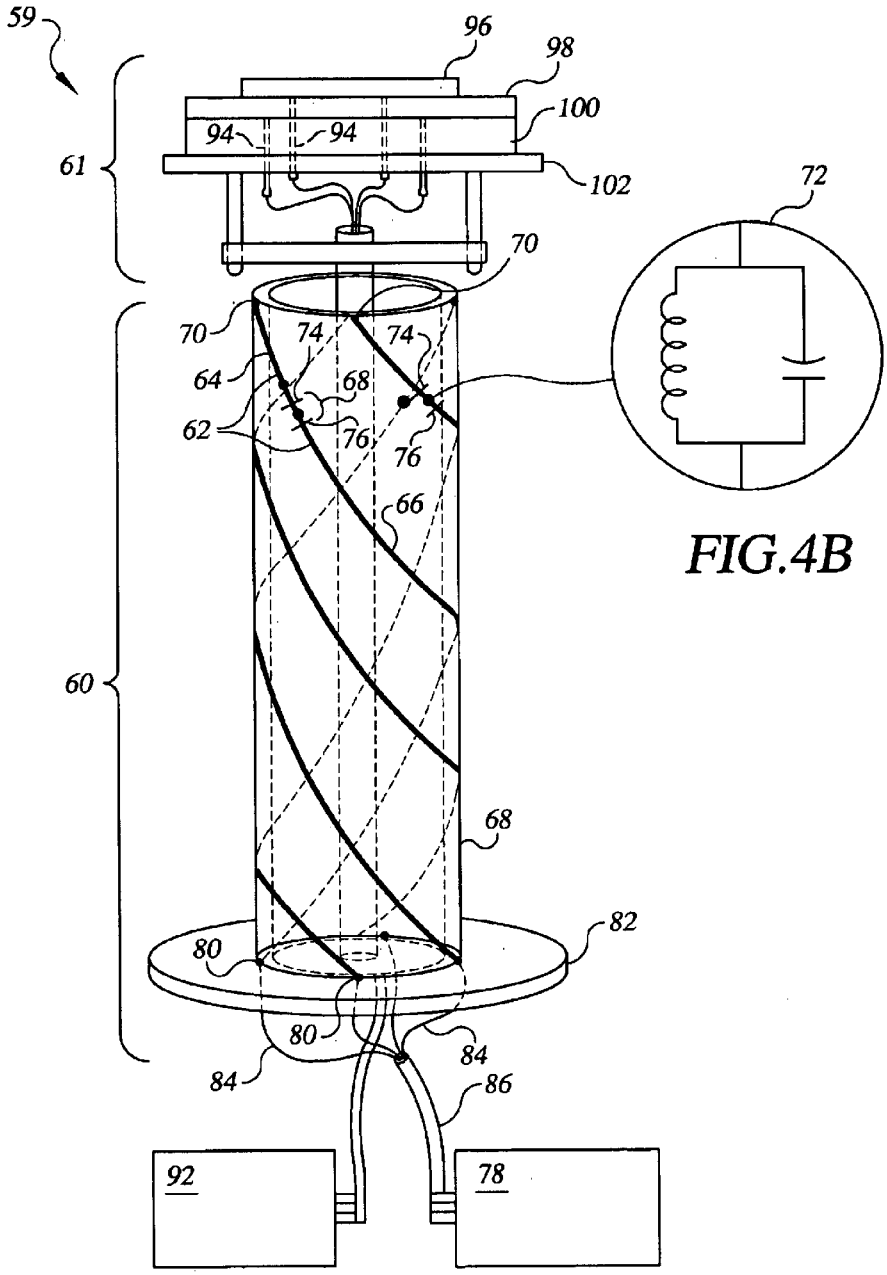
FIG. 4A is an illustration of a side view of a third embodiment of an antenna array in accordance with the invention.
FIG. 4B is an illustration of a trap circuit in accordance with the invention.

The trap circuits 72 are passive circuits that operate as switches. As shown in FIG. 4B, they are each comprised of a parallel LC circuit (lumped components) that has infinite impedance (i.e., it forms an open circuit) at its resonant frequency. At the lower frequency, the trap circuits have low reactive impedance that can be compensated by a slight change in the length of the upper portions 64. Thus, at the resonant frequency of the trap circuits, which coincides with the center frequency of the higher operational frequency band of the antenna, only the lower portions 66 of the trap-loaded QHA 60 effectively radiate energy.

The dual-band QHA 60 requires a feed network 78 to provide the 0°, 90°, 180° and 270° feed signals 84 needed to drive radiating elements 62. A feed network such as illustrated in FIG. 6 and electrical connection scheme as described above is suitable and was employed in the working model described below. As in the case of the single frequency QHA, directing the radiation pattern from this "bottom-fed" trap-loaded QHA 60 in the forward axial direction (toward the upper hemisphere) requires placement of a small ground plane 82 perpendicular to the axis of the cylinder defined by the radiating elements 62 and proximate to the feed points 80 to redirect the inherently backfire radiation. The ground plane 82 may have any shape, but is preferably circular and has a diameter equal to or greater than one third of the free space wavelength of the signals being received and/or transmitted.

Figure 5:
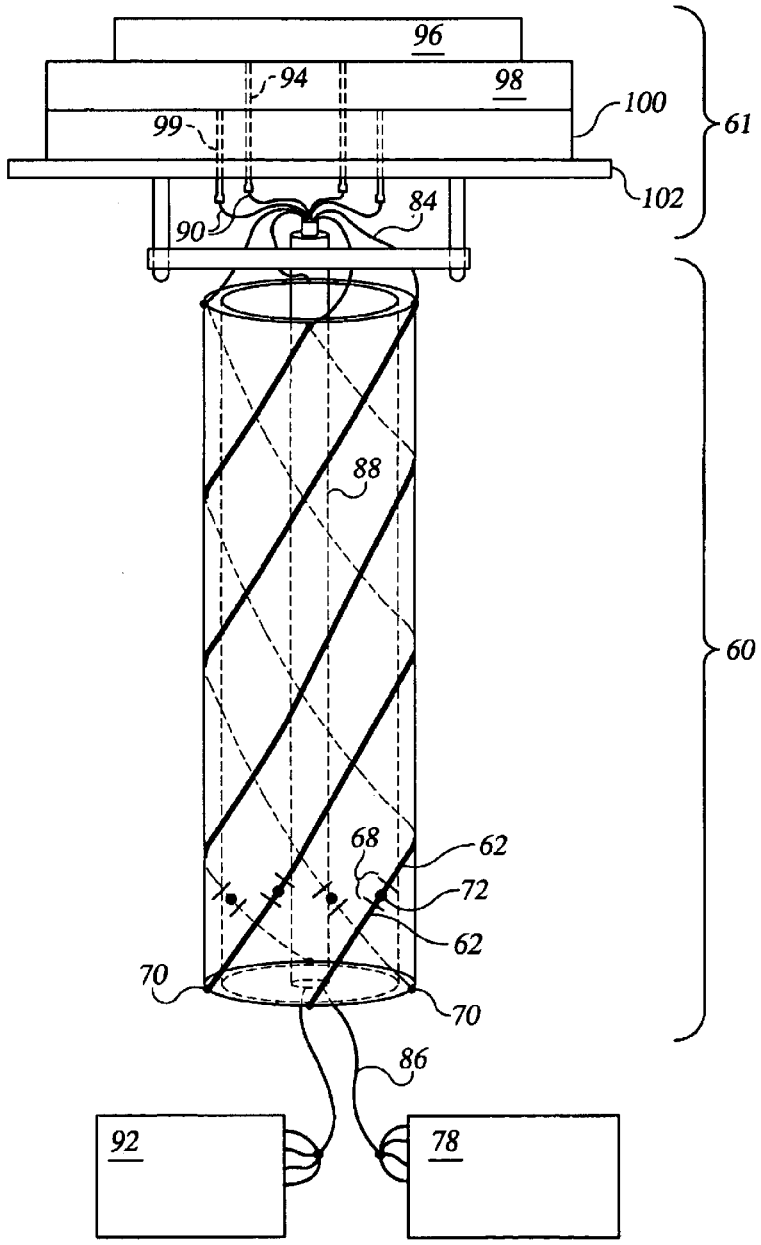
FIG. 5 is an illustration of a fourth embodiment of an antenna array in accordance with the invention.

FIG. 5 illustrates an embodiment of the antenna array 59 employing a "top-fed" trap-loaded QHA 60 which requires no ground plane but a right-hand twist for its radiating elements 62. A signal transport scheme similar to that described above is preferably employed, wherein trap-loaded feed signals 84 are transported on coaxial feed cables 86 disposed within a tube 88 extending along the central axis of the trap-loaded QHA 60 with negligible impact on the array's performance. The tube 88 may additionally provide mechanical support to the stacked patch antenna 61 and preferably also transports stacked patch feed signals 90 from the patch feed network 92 to one or more feed pins 94 of each auxiliary patch element 96,98.

The auxiliary stacked patch antenna 61 is comprised of two symmetrically shaped microstrip patches 96,98 that are stacked one above the other with a high dielectric substrate layer 100 and a small ground plane 102 beneath them. This arrangement creates a double tuned circuit, with the upper auxiliary patch 96 resonant at the higher frequency (e.g., L1), and the lower auxiliary patch 98 that has a larger surface area resonant at the lower frequency (e.g., L2). A high dielectric constant ($\epsilon$=12.8) material was used to form the substrate layer 100 of the working model described below, helping to reduce the antenna's overall size. The small ground plane 102 (~2" per side in this L band model) makes it both dimensionally compact and also improves the polarization ratio of the patch pattern at or near the horizon.

In the embodiments illustrated in FIGS. 4 and 5, optimal circular polarization excitation of the stacked patch 61 occurs through direct connections to two pairs of feed pins 94, one pair for each auxiliary patch element 96,98. However, alternative excitation schemes are known and considered to be within the scope of the present invention. For example, excitation schemes employing fewer direct connections may employed, or even configurations wherein excitation is provided through electromagnetic coupling (such as described by D. M Pozar el al., "A Dual-Band Circularly Polarized Aperture-Coupled Stacked Microstrip Antenna for Global Position Satellite", *IEEE Trans. Antennas and Propagation*, Vol. AP-45, November 1997, pp 1618–1625, the contents of which are hereby incorporated by reference). In the embodiments depicted, each pair of feed pins 96,98 is fed with 90° phase separated patch feed signals 90. These signals can be obtained from a patch feed network 92 comprised of a 90° hybrid. The location of each pair of feed pins 94 is chosen to minimize the reflection loss for each resonant frequency.

Adaptive Nulling Performance of Working Model

The applicants have successfully designed and constructed a dual frequency band null steering array for use in satellite navigation and/or communications systems, and especially with an adaptive nulling processor for interference rejection. The array was designed to provide rhcp coverage over a hemisphere at two frequencies, 1227 MHz and 1575 MHz (the L2 and L1 GPS bands) and to selectively steer pattern minima in both frequency bands along the horizon in order to suppress interfering signals. The model is configured with a small ground plane (2" in diameter) at the base of a trap-loaded QHA. The auxiliary stacked patch antenna is comprised of two square microstrip patches stacked one above the other with a high dielectric substrate ($\epsilon_r$=12.8) and small ground plane below them.

The dimensions, in inches, of four radiating elements that were formed into the model trap-loaded QHA are reflected in FIG. 7. The radiating elements were formed from narrow copper strips positioned upon a thin, flexible mylar sheet that was then rolled into a cylinder approximately 1 inch in diameter. A Styrofoam core was employed to maintain the cylindrical shape and provide support for the radiating elements. For this design, the resonant input impedance at the two specified frequencies was approximately 50 ohms. The trap circuits' components, inductors (L=6.8 nh) and capacitors (C=1.5 pf), were soldered across the gap in each radiating element at approximately 0.6 inches from the open ends of the radiating elements. While the product, LC, must be determined by the resonant frequency of the trap circuit, the choice of a particular combination of L and C affects the required length of the upper portions of the radiating elements. Also, if the inductance has significant ohmic loss, it will reduce the radiation efficiency at the lower frequency band. The four radiating elements were attached at their feed points to the center conductors of four coaxial connectors through a ground plate whose diameter of approximately 3 inches was selected to reflect most of the energy radiated from the antenna to the upper hemisphere while still maintaining coverage for angles just below the horizon (i.e., a cardioid pattern).

The nulling capability and the associated patterns of the patch/helix antenna array was evaluated by measurements and pattern synthesis simulation. The antenna patterns were measured using a spherical near field scanner.

Figure 8A:
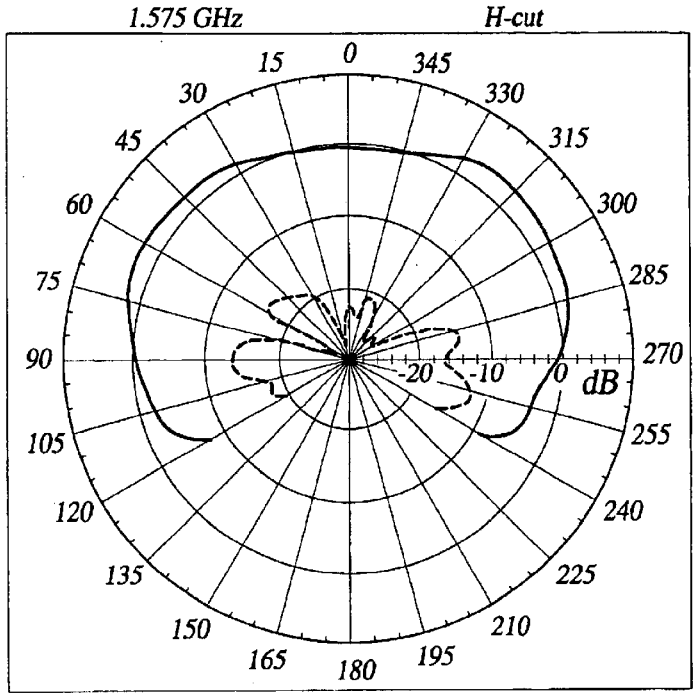
FIGS. 8A and 8B are charts reflecting measured elevation patterns in the L1 and L2 bands of a dual band quadrifilar helix antenna employed in a working null steering array model constructed in accordance with the invention.
Figure 8B:
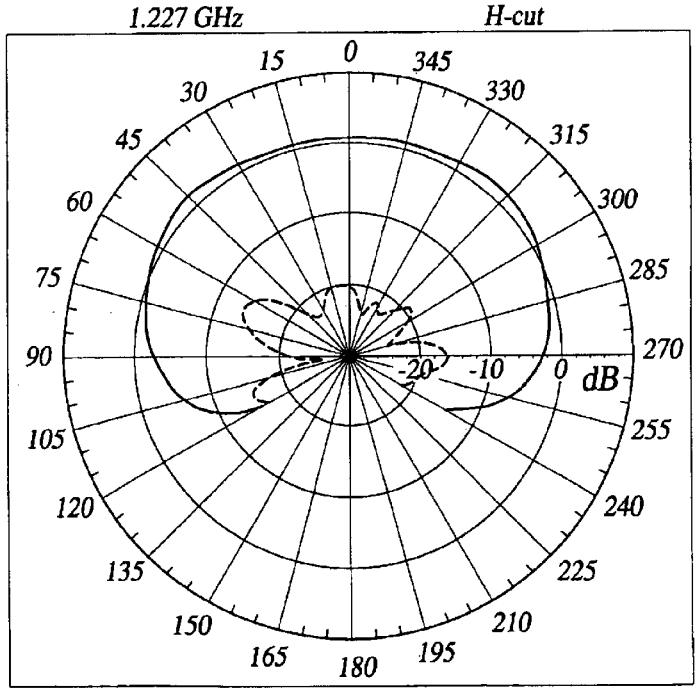
Figure 9:
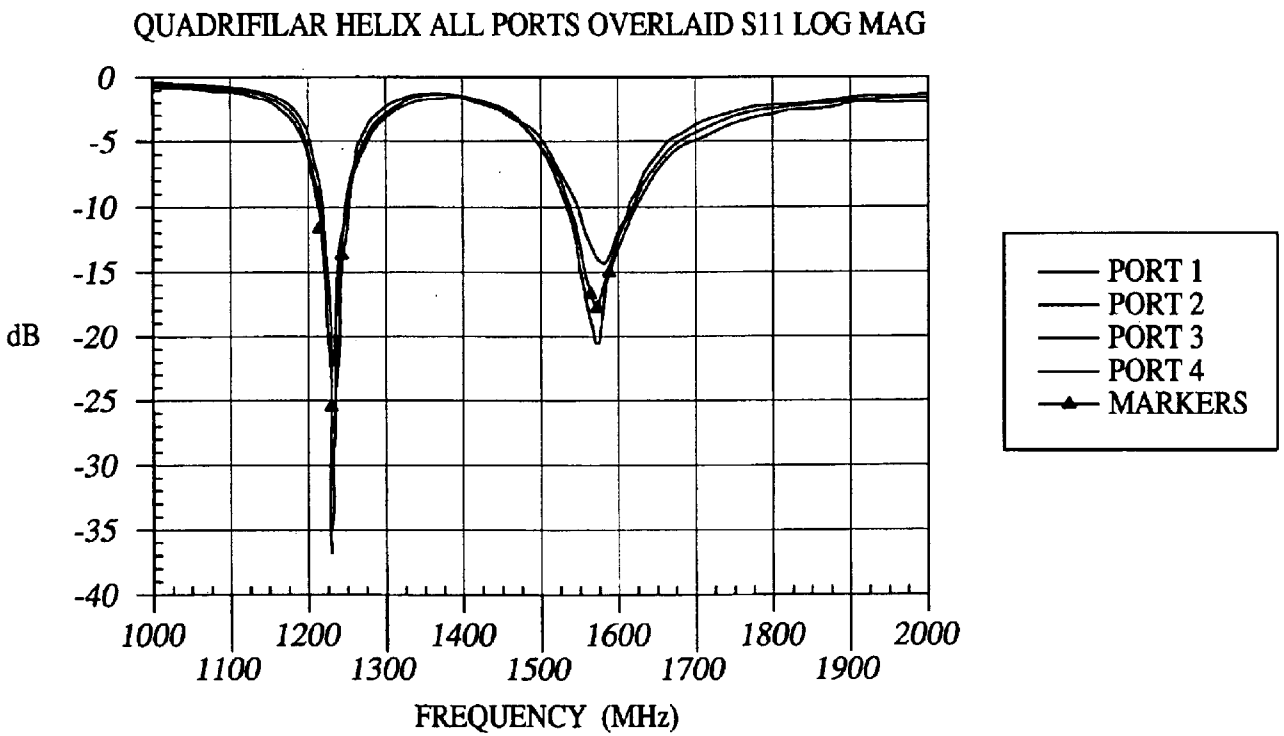
FIG. 9 is a plot of reflection coefficients at the input feed points to each of the four arms of the working model.

FIGS. 8A and 8B depict elevation plane patterns for the trap-loaded QHA measured at the center frequencies of the L1 and L2 frequency bands. The solid-line curves represent the right hand circularly polarized patterns and the dashed-line curves represent the left hand circularly polarized patterns, respectively. Note that the antenna achieves small gain variation (<4 dB over the upper hemisphere and <2 dB to 80 degrees from the zenith). The input match for the trap-loaded QHA is illustrated in FIG. 9 by an overlay of the reflection coeficients at the input (feed points) to each of the four arms (radiating elements) of the helix. The QHA feed network was designed and created from commercial off the shelf components, a 180° hybrid and two 90° hybrids, that are compact and wideband.

Figure 10A:
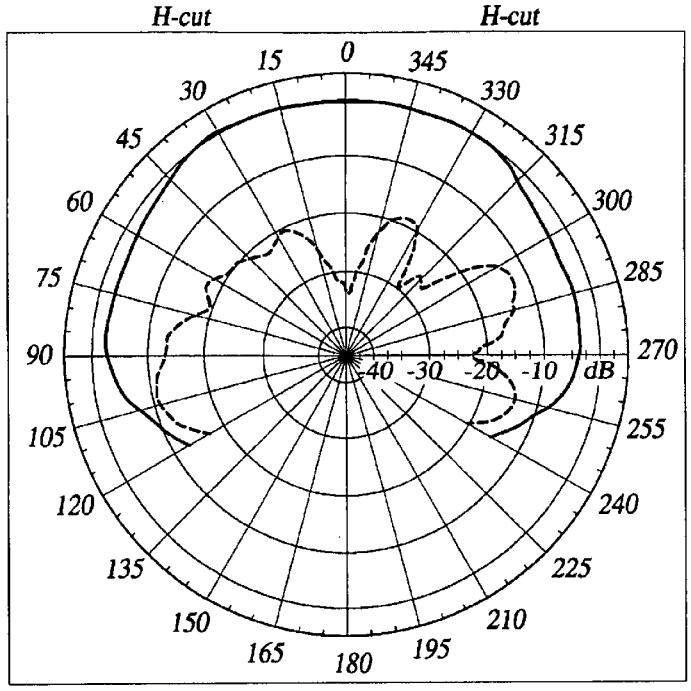
FIGS. 10A and 10B are charts reflecting measured elevation patterns in the L1 and L2 bands of a stacked microstrip patch antenna employed in a working null steering array model constructed in accordance with the invention.
Figure 10B:
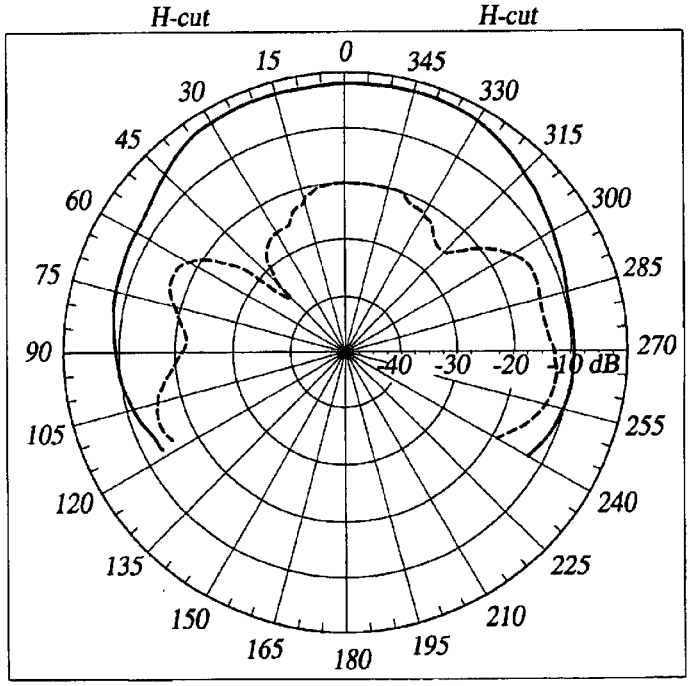
Figure 11:
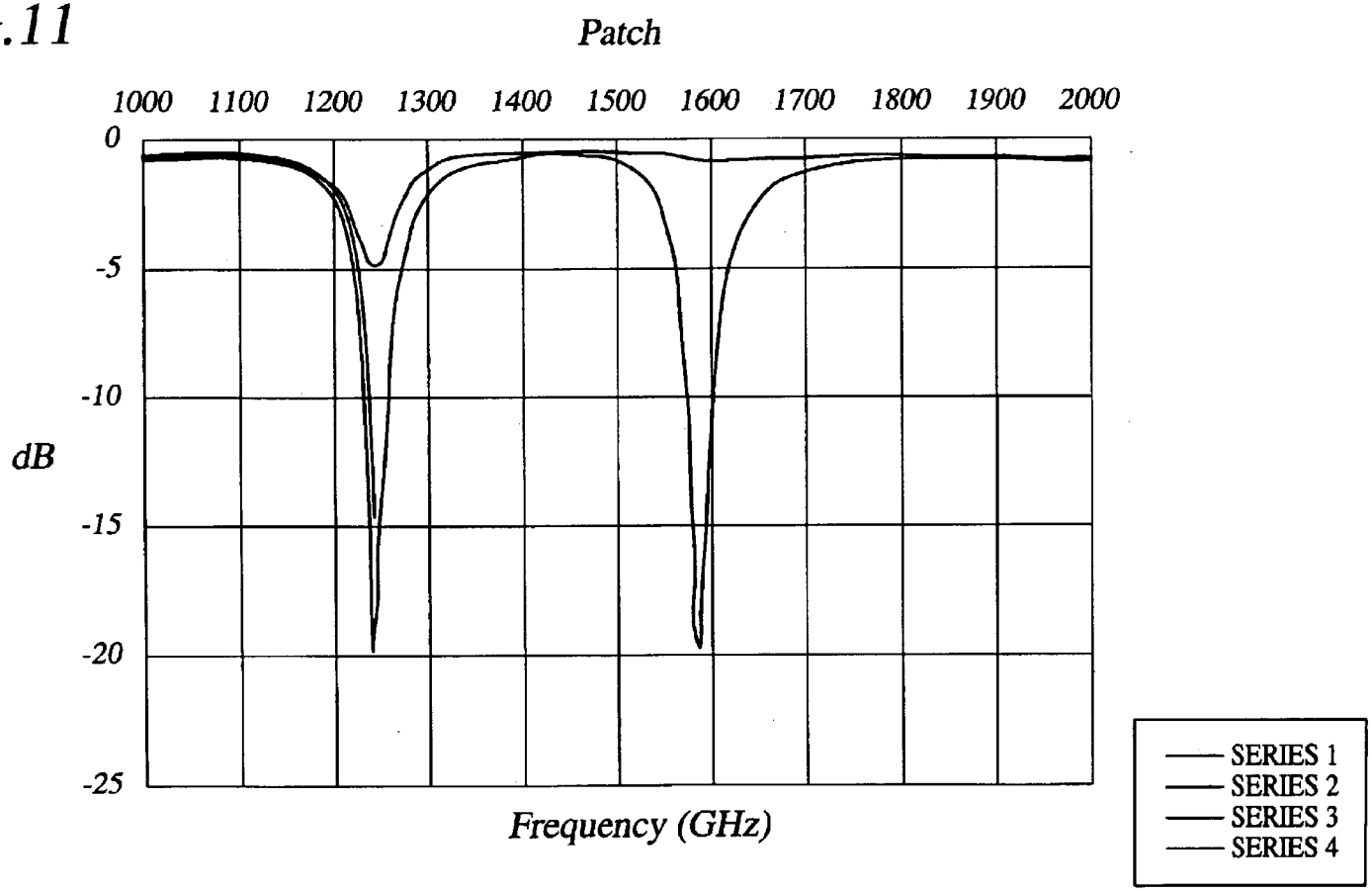
FIG. 11 is a plot of reflection coefficients at the input feed points to each of the stacked microstrip patch elements of the working model.

FIGS. 10A and 10B depict elevation plane patterns for the stacked patch antenna measured at the center frequencies of the L1 and L2 bands. Using a separate pair of probes (feed pins) to excite each patch with 90° phase separation optimized the polarization ratio for right-hand circular polarization over most of the field of view. The location of each pair of probes was chosen to minimize the reflection loss for each frequency as shown in FIG. 11.

Figure 12B:
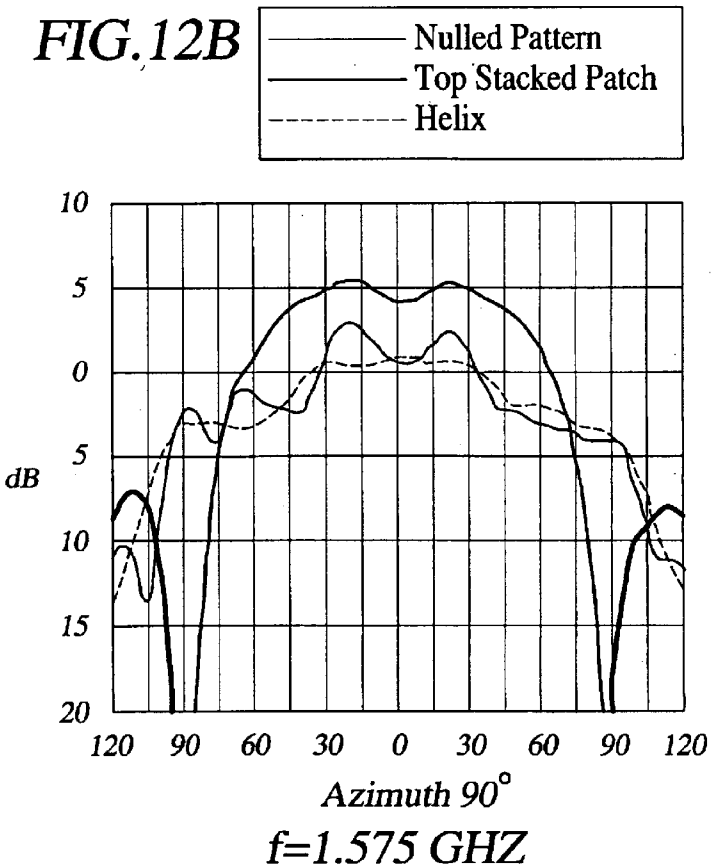
FIGS. 12A–C are plots of synthesized radiation pattern plane cuts of the null steering array model using one complex weight across the L1 band.
Figure 12A:
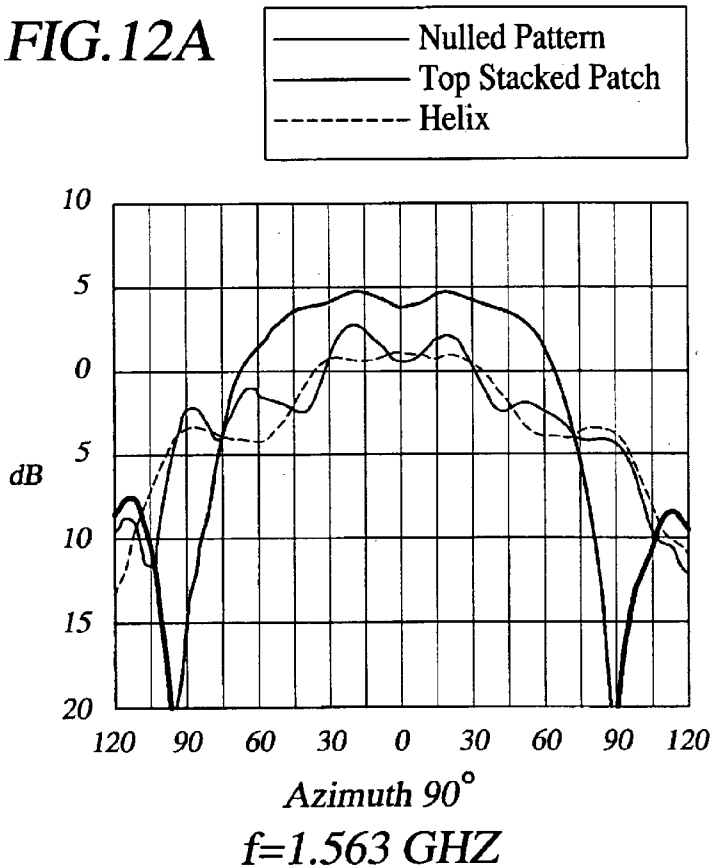
Figure 13A:
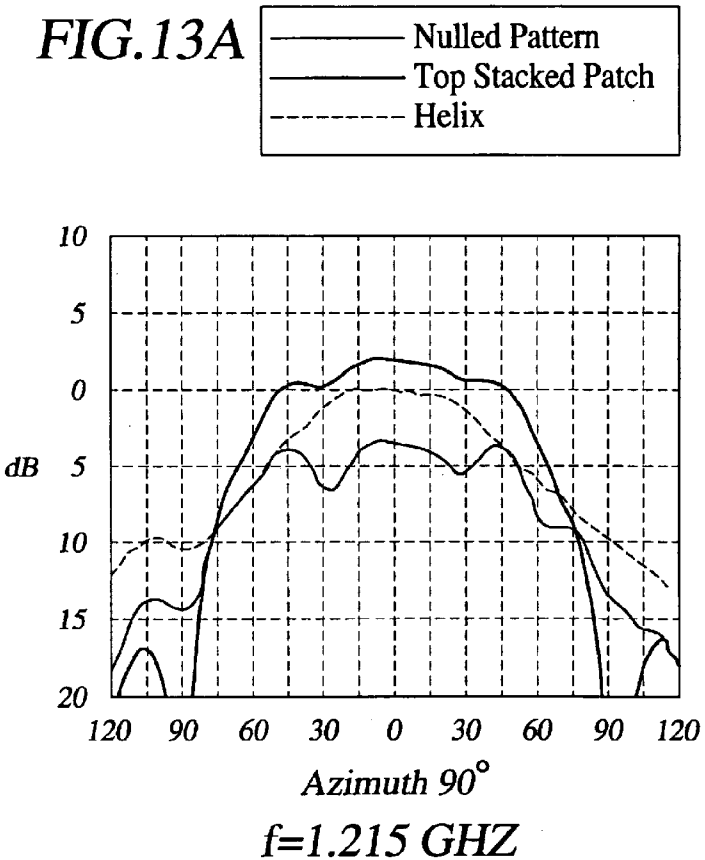
FIGS. 13A–C are plots of synthesized radiation pattern plane cuts of the null steering array model using one complex weight across the L2 band.
Figure 12C:
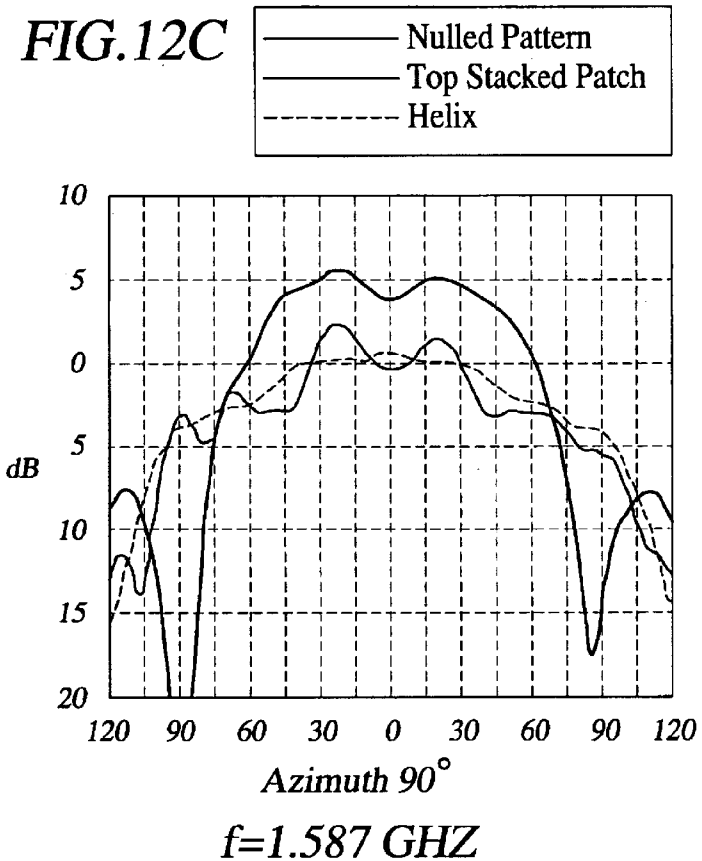
Figure 13B:
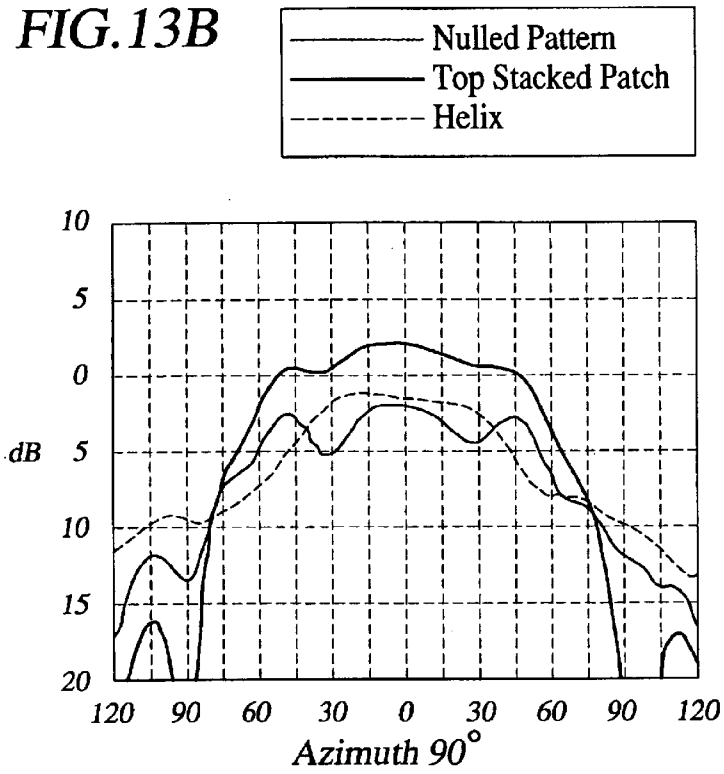
Figure 13C:
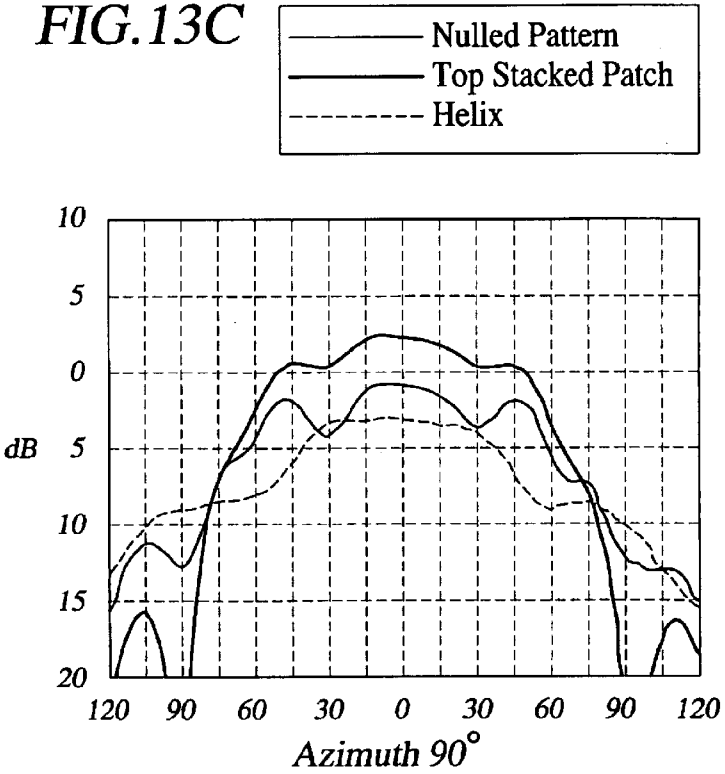

The amplitude and phase patterns of the antennas were each measured at the center and edge frequencies in both the L1 and L2 frequency bands. To demonstrate the expected pattern with a null created at the horizon, the two measured right-hand circular polarization patterns were added using a computer synthesis to create a composite pattern with the appropriate amplitude and phase weight. In each case the weight was chosen for the center frequency and the same weight applied to the patterns band edge frequencies to demonstrate the frequency sensitivity of the weights. The resulting elevation plane cuts are shown in FIGS. 12A–C for L1 and FIGS. 13A–C for L2. Note that creating the ring null near the horizon with two antenna elements increases the gain over most of the remainder of the upper hemisphere.

Other embodiments of the invention will be apparent to those skilled in the art from a consideration of the specification or practice of the invention disclosed herein. For instance, in practical implementations a compact protective radome may be used. The radome could be formed from a dense foam or a more rigid, but thin, composite material. The latter would require retuning the four radiating elements of the helix (modifying their length) to compensate for the effect of the dielectric material in the radome. In other embodiments also within the scope of the present invention, the trap circuits could be created from printed circuit components (L and C) rather than the discrete components that were used in the model described above. Additionally, in each illustrated embodiment of the invention, the feed networks are depicted as being disposed below the helix. Alternatively, the feed networks could be placed in the gap between the QHA and the ground plane of the patch (or stacked patch) antenna. It is intended that the specification and examples be considered as exemplary only, with the true scope and spirit of the invention being indicated by the following claims.

What is claimed is:

1. A spatial null steering antenna array, comprising:

a resonant quadrifilar helix antenna having a plurality of feed locations;

means for feeding the plurality of feed locations in phase quadrature to produce circular polarization in a resonant frequency band;

a ground plate coaxially aligned with and vertically displaced above the quadrifilar helix antenna;

a dielectric layer and an auxiliary patch resonant in that frequency band coaxially aligned and vertically stacked on the ground plate, the auxiliary patch having one or more feed pins;

means for feeding the one or more feed pins of the auxiliary patch in order to produce a combined circularly polarized radiation pattern minimum at selected elevation angles in the frequency band.

2. The spatial null steering antenna array of claim 1, wherein the resonant frequency band is in a satellite frequency range.

3. The spatial null steering antenna array of claim 1, wherein the resonant frequency band is a L1 band.

4. The spatial null steering antenna array of claim 1, wherein the resonant frequency band is a L2 band.

5. The spatial null steering antenna array of claim 1, further comprising a protective radome covering the quadrifilar helix antenna and auxiliary patch.

6. The spatial null steering antenna array of claim 1, further comprising: means for supporting the helical structure of the quadrifilar helix antenna.

7. The spatial null steering antenna array of claim 1, wherein the resonant quadrifilar helix antenna further comprises:

four radiating elements for radiating RHCP arranged helically with a left twist defining a cylinder of constant radius, each radiating element having an electrically open end near the ground plate and another end having an electrically conductive feed location; and a ground plane coaxially positioned below the four radiating elements.

8. The spatial null steering antenna array of claim 7, wherein the ground plane is substantially circular and has a diameter equal to or greater than one third of the wavelength in free space of the signals being fed to the feed locations.

9. The spatial null steering antenna array of claim 7, wherein the means for feeding the quadrifilar helix antenna further comprises:

a 180° hybrid for providing from an input signal first and second output signals that differ from each other by 180°;

a first 90° hybrid having an input arm for accepting the first output signal from the 180° hybrid and further having a first output arm for providing a third output signal and a second output arm for providing a fourth output signal, wherein the third and fourth output signals differ from one another by 90°;

a second 90° hybrid having an input arm for accepting said second output signal from the 180° hybrid and further having a third output arm for providing a fifth output signal and a fourth output arm for providing a sixth output signal, wherein said fifth and sixth output signals differ from one another by 90°; and wherein the third, fourth, fifth and sixth output signals are provided to the feed locations of the four radiating elements.

10. The spatial null steering antenna array of claim 7, wherein the means for feeding the quadrifilar helix antenna further comprises:

a 90° hybrid for providing from an input signal first and second output signals that differ from each other by 90°;

a first 180° hybrid having an input arm for accepting the first output signal from the 90° hybrid and further having a first output arm for providing a third output signal and a second output arm for providing a fourth output signal, wherein the third and fourth output signals differ from one another by 180°;

a second 180° hybrid having an input arm for accepting said second output signal from the 90° hybrid and further having a third output arm for providing a fifth output signal and a fourth output arm for providing a sixth output signal, wherein said fifth and sixth output signals differ from one another by 180°; and wherein the third, fourth, fifth and sixth output signals are provided to the feed locations of the four radiating elements.

11. The spatial null steering antenna array of claim 1, wherein the resonant quadrifilar helix antenna has a top and bottom and further comprises:

four radiating elements for radiating RHCP arranged helically with a right twist defining a cylinder of constant radius, each radiating element having one end with an electrically conductive feed location at the top of the helix antenna, and another electrically open end at the bottom of the helix antenna.

12. The spatial null steering antenna array of claim 11, wherein the means for feeding the quadrifilar helix antenna further comprises:

a 180° hybrid for providing from an input signal first and second output signals that differ from each other by 180°;

a first 90° hybrid having an input arm for accepting the first output signal from the 180° hybrid and further having a first output arm for providing a third output signal and a second output arm for providing a fourth output signal, wherein the third and fourth output signals differ from one another by 90°;

a second 90° hybrid having an input arm for accepting said second output signal from the 180° hybrid and further having a third output arm for providing a fifth output'signal and a fourth output arm for providing a sixth output signal, wherein the fifth and sixth output signals differ from one another by 90°; and wherein the third, fourth, fifth and sixth output signals are provided to the feed locations of the four radiating elements through a conduit extending along the axis of and above the quadrifilar helix antenna through which auxiliary patch feed signals are also carried.

13. The spatial null steering antenna array of claim 1, further comprising:

means for supporting the ground plate relative to the quadrifilar helix antenna.

14. The spatial null steering antenna array of claim 13, wherein the support means further comprises:

a conduit extending along the axis of and above the quadrifilar helix antenna through which auxiliary patch feed signals are carried.

15. The spatial null steering antenna array of claim 13, further comprising:

a conduit mechanism extending along the axis within and above the quadrifilar helix antenna, through which quadrifilar helix antenna feed signals are also carried.

16. The spatial null steering antenna array of claims 7 or 11, wherein the four radiating elements are further comprised of strips of electrically conductive material printed on a dielectric support.

17. The spatial null steering antenna array of claims 7 or 11, wherein each radiating element has a length less than or equal to the wavelength in free space of the signals being fed to the feed locations.

18. The spatial null steering antenna array of claims 7 or 11, wherein each radiating element completes at most one helical turn.

19. The spatial null steering antenna array of claim 1, wherein the auxiliary patch has substantially square or round resonant dimensions.

20. The spatial null steering antenna array of claim 1, wherein the auxiliary patch feed means further comprises:

a weighting feed network to adaptively or predictively steer the direction of the spatial null in the antenna pattern.

21. The spatial null steering antenna array of claim 1, wherein the auxiliary patch feed means further comprises:

a first 90° hybrid having a first output arm for providing from an input signal a first output signal and a second output arm for providing a second output signal, wherein the first and second output signals differ from one another by 90°;

a set of feed wires electrically connected to the first and second output arms and carried through a conduit extending along the axis of and above the quadrifilar helix antenna; and wherein the one or more auxiliary patch feed pins extend through holes in the ground plate and dielectric layer for electrical connection to the set of feed wires.

22. A dual-band spatial null steering antenna array, comprising:

a dual-band quadrifilar helix antenna resonant in a first frequency band and a second frequency band having a plurality of feed locations;

means for feeding the plurality of feed locations of the dual-band quadrifilar helix antenna to produce circular polarization in the first frequency band and the second frequency band;

a ground plate coaxially aligned with and vertically displaced above the dual-band quadrifilar helix antenna;

a first auxiliary patch resonant in the first frequency band and a second auxiliary patch resonant in the second frequency band coaxially aligned and vertically stacked on a dielectric substrate layer on top of the ground plate;

means for feeding the first patch and the second patch to produce combined circularly polarization pattern minima at selected elevation angles in the first and the second frequency bands.

23. The dual-band spatial null steering antenna array of claim 22, wherein the first frequency band and second frequency band are in a satellite frequency range.

24. The dual-band spatial null steering antenna array of claim 22, wherein the first frequency band is a L2 band.

25. The dual-band spatial null steering antenna array of claim 22, wherein the second frequency band is a L1 band.

26. The dual-band spatial null steering antenna array of claim 22, further comprising a protective radome covering the dual-band quadrifilar helix antenna and the stacked auxiliary patches.

27. The dual-band spatial null steering antenna array of claim 22, further comprising means for supporting the helical structure of the dual-band quadrifilar helix antenna.

28. The dual-band spatial null steering antenna array of claim 22, further comprising means for supporting the position of the ground plate and stacked patches relative to the dual-band quadrifilar helix antenna.

29. The dual-band spatial null steering antenna array of claim 28, wherein the support means further comprises:

a conduit mechanism extending coaxially within and above the dual-band quadrifilar helix antenna through which the means for feeding the first patch and the second patch are carried.

30. The dual-band spatial null steering antenna array of claim 28, further comprising:

a conduit mechanism extending coaxially within and above the quadrifilar helix antenna, through which quadrifilar helix antenna feed signals are also carried.

31. The dual-band spatial null steering antenna array of claim 22, further comprising means for supporting the helical structure of the dual-band quadrifilar helix antenna.

32. The dual-band spatial null steering antenna array of claim 22, wherein the ground plane is a substantially circular metal plate.

33. The dual-band spatial null steering antenna array of claim 22, wherein the means for feeding the first patch and the second patch further comprises:

a weighting network to adaptively or predictively steer the direction of the spatial null in the array pattern.

34. The dual-band spatial null steering antenna array of claim 22, wherein the dual-band quadrifilar helix antenna further comprises:

four radiating elements for radiating RHCP arranged helically with a left twist defining a cylinder of constant radius, each radiating element having an upper portion and a lower portion and a gap there between, each upper portion having an open end, and each lower portion having one of the plurality of feed locations for receiving feed signals in phase quadrature;

four traps, one corresponding trap each disposed in the gap and electrically connected to the upper portion and lower portion of a corresponding one of the four radiating elements equidistant from the corresponding open end, the traps configured to have a first impedance in the first frequency band, and a second impedance greater than the first impedance in the second frequency band; and a ground plane coaxially positioned below the four radiating elements.

35. The dual-band spatial null steering antenna array of claim 34, wherein the four radiating elements are further comprised of strips of electrically conductive material printed on a dielectric support.

36. The dual-band spatial null steering antenna array of claim 34, wherein the ground plane is substantially circular and has a diameter equal to or greater than one third of the wavelength in free space of the feed signals being fed to the feed locations.

37. The dual-band spatial null steering antenna array of claim 34, wherein the means for feeding the dual-band quadrifilar helix antenna further comprises:

a 180° hybrid for providing from an input signal first and second output signals that differ from each other by 180°;

a first 90° hybrid having an input arm for accepting said first output signal from said 180° hybrid and further having a first output arm for providing a third output signal and a second output arm for providing a fourth output signal, wherein said third and fourth output signals differ from one another by 90°;

a second 90° hybrid having an input arm for accepting said second output signal from said 180° hybrid and further having a third output arm for providing a fifth output signal and a fourth output arm for providing a sixth output signal, wherein said fifth and sixth output signals differ from one another by 90°; and wherein the third, fourth, fifth and sixth output signals are provided to the feed locations of the four radiating elements.

38. The dual-band spatial null steering antenna array of claim 34, wherein the length of each of the four radiating elements is less than or equal to the wavelength in free space of the signals being fed to the feed locations.

39. The dual-band spatial null steering antenna array of claim 34, wherein each radiating element completes at most one helical turn.

40. The dual-band spatial null steering antenna array of claim 34, wherein the traps are comprised of printed circuit components.

41. The dual-band spatial null steering antenna array of claim 22, wherein the dual-band quadrifilar helix antenna has a top and a bottom and further comprises:

four radiating elements for radiating RHCP arranged helically with a right twist defining a cylinder of constant radius, each radiating element having an upper portion and a lower portion and a gap there between, each upper portion having one of the plurality of feed locations for receiving feed signals in phase quadrature at the top of the helix, and each lower portion having an electrically open end at the bottom of the helix; and four traps, one corresponding trap each disposed in the gap and electrically connected to the upper portion and lower portion of a corresponding one of the four radiating elements equidistant from the corresponding open end, the traps configured to have a first impedance in the first frequency band, and a second impedance greater than the first impedance in the second frequency band.

42. The dual-band spatial null steering antenna array of claim 41, wherein the means for feeding the quadrifilar helix antenna further comprises:

a 180° hybrid for providing from an input signal first and second output signals that differ from each other by 180°;

a first 90° hybrid having an input arm for accepting said first output signal from said 180° hybrid and further having a first output arm for providing a third output signal and a second output arm for providing a fourth output signal, wherein said third and fourth output signals differ from one another by 90°;

a second 90° hybrid having an input arm for accepting said second output signal from said 180° hybrid and further having a third output arm for providing a fifth output signal and a fourth output arm for providing a sixth output signal, wherein said fifth and sixth output signals differ from one another by 90°; and wherein the third, fourth, fifth and sixth output signals are provided to the feed locations of the four radiating elements through a conduit mechanism extending coaxially within and above the dual-band quadrifilar helix antenna.

43. The dual-band spatial null steering antenna array of claim 41, wherein the four radiating elements are further comprised of strips of electrically conductive material printed on a dielectric support.

44. The dual-band spatial null steering antenna array of claim 41, wherein the length of each of the four radiating elements is less than or equal to the wavelength in free space of the signals being fed to the feed locations.

45. The dual-band spatial null steering antenna array of claim 41, wherein each radiating element completes at most one helical turn.

46. The dual-band spatial null steering antenna array of claim 41, wherein the traps are comprised of printed circuit components.

47. The dual-band spatial null steering antenna array of claim 22, wherein the first and second auxiliary patches have substantially square dimensions; and the first auxiliary patch has a greater surface area than the second auxiliary patch and is stacked below the second auxiliary patch.

48. The dual-band spatial null steering antenna array of claim 22, wherein the first and second auxiliary patches have substantially round dimensions; and the first auxiliary patch has a greater surface area than the second auxiliary patch and is stacked below the second auxiliary patch.

49. The dual-band spatial null steering antenna of claim 22, wherein the means for feeding the first patch and the second patch further comprises:

a first set of one or more feed pins electrically connected to the first auxiliary patch and extending through the ground plate and dielectric layer, and a second set of one or more feed pins electrically connected to the second auxiliary patch and extending through the ground plate, dielectric layer and first auxiliary patch; and a feed network electrically connected to the first and second sets that feeds feed signals resulting in circularly polarized radiation.

50. The dual-band spatial null steering antenna array of claim 49, wherein each set of feed pins is a corresponding pair of feed pins; and the feed network is further comprised of one or more 90° hybrids.

51. The dual-band spatial null steering antenna array of claim 22, wherein the means for feeding the first patch and second patch further comprises electromagnetic coupling means.

* * * * *